United States Patent [19]

Fabris

[11] Patent Number: 4,623,509

[45] Date of Patent: Nov. 18, 1986

[54] SAFETY DEVICE FOR A NUCLEAR FUEL ELEMENT LOADING MECHANISM

[75] Inventor: Mirko Fabris, Nivelles, Belgium

[73] Assignee: Ateliers de Constructions Electriques de Charleroi, Brussels, Belgium

[21] Appl. No.: 471,169

[22] Filed: Mar. 1, 1983

[30] Foreign Application Priority Data

Mar. 8, 1982 [EP] European Pat. Off. ..... 82200290.3

[51] Int. Cl.[4] ..... G21C 19/00

[52] U.S. Cl. ..... 376/268; 376/269; 376/271; 242/86

[58] Field of Search ..... 376/268, 269, 271; 242/86.1, 86, 84.5 A, 86.5 A, 107.1

[56] References Cited

U.S. PATENT DOCUMENTS

| | | | |
|---|---|---|---|
| 3,090,741 | 5/1963 | Fawcett | 376/269 |
| 3,391,876 | 7/1968 | Dalglish | 242/68 X |
| 3,904,048 | 9/1975 | Santen et al. | 376/271 |
| 3,909,350 | 9/1975 | Dupuy | 376/271 |
| 4,012,002 | 3/1977 | McDonald et al. | 242/86 X |
| 4,053,118 | 10/1977 | Aikins | 242/86.1 X |
| 4,374,801 | 2/1983 | Albin | 376/268 X |

FOREIGN PATENT DOCUMENTS

| | | | |
|---|---|---|---|
| 138994 | 10/1979 | Japan | 376/268 |

*Primary Examiner*—Peter A. Nelson

*Attorney, Agent, or Firm*—Schwartz, Jeffery, Schwaab, Mack, Blumenthal & Evans

[57] ABSTRACT

The safety device consists of doubling a first reel (4) equipped with an operating cable (11) from a carriage (24) for nuclear fuel elements is suspended, by a second reel (5) equipped with an emergency cable (12) connected with the carriage (24) and following the displacement of the carriage in a synchronous manner with the aid of a set of cog-wheels (6 and 7) joined respectively with the reels (4 and 5) by means of reducing gears (2 and 3) and connected with each other by a notched belt (8).

To attenuate the impact in case of a rupture of the operating cable (11) and the loading of the emergency cable (12), the carriage (24) is equipped with an attenuating system (22) and an elastic connecting system (20).

7 Claims, 9 Drawing Figures

SAFETY DEVICE FOR A NUCLEAR FUEL ELEMENT LOADING MECHANISM

In nuclear power stations, fuel elements are manipulated by means of travelling cranes of sometimes very different characteristics. For reasons of space, new fuel elements are generally charged by means of travelling cranes equipped with a short type gripping tool. In contrast, travelling cranes operating above the reactor, storage racks or the deactivating pool are equipped with gripping tools of the long type. A stationary loading mechanism, equipped with its own lifting system, permits the vertical displacement in the pool of a carriage equipped with a basket wherein a fuel element may be sliding.

When raised in the pool to a certain level, the carriage of the loading mechanism may, for example, receive the new fuel element delivered by means of a shoft gripping tool, then descend to a lower level to permit the seizing of said fuel element by a long gripping tool to be transported subsequently by the travelling crane equipped in this manner to its place of destination.

In order to adapt to new methods for the recovery of components that are still usable in depleted fuel elements, the carriage of the stationary loading mechanism is equipped with two baskets to transfer, from a basket containing a depleted fuel element, components that are still usable into the other basket containing an empty assembling structure.

This carriage, which is constantly immersed in the pool and connected by a cable with its own lifting system, runs the risk of being crushed on the floor of the pool subsequently to a rupture of the cable, thereby dispersing certain irradiated components capable of contaminating the pool.

It is the object of the present invention to protect against the consequences of the rupture of the cable by doubling in a synchronous manner the lifting means of the carriage and by equipping the carriage with a shock absorbing system to attenuate the effects of the impact following the rupture of the cable in service.

The invention will become apparent in detail from the figures attached hereto:

Figure 1:
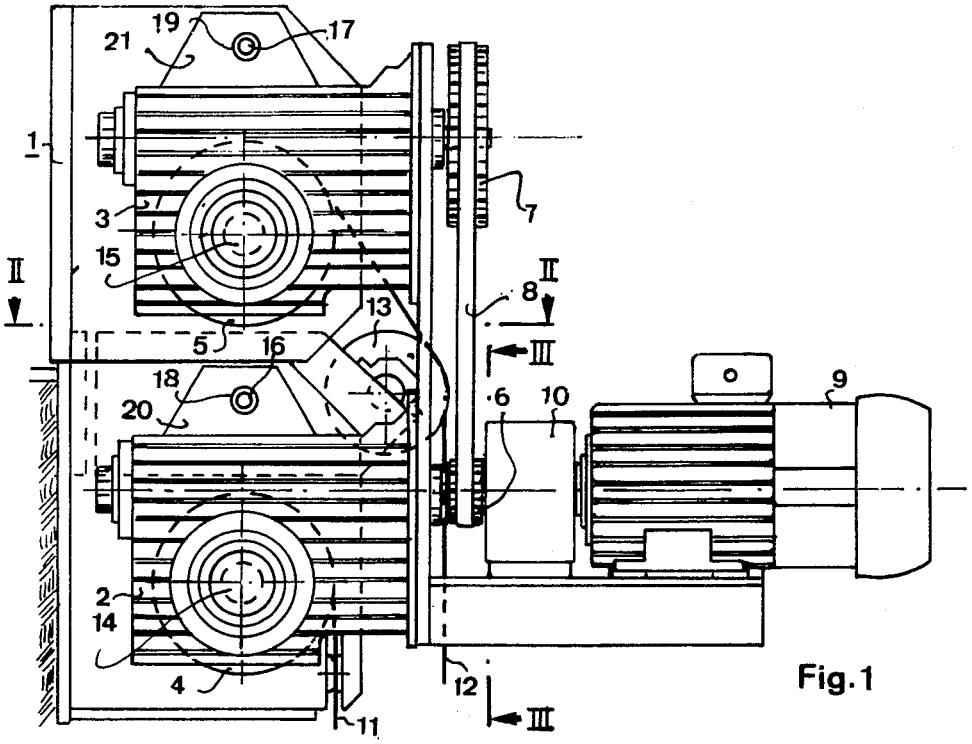
FIGS. 1, 2 and 3 show the configuration of the carriage.

FIG. 1 shows a frame 1 upon which are mounted two reduction gears 2 and 3 driving two reels 4 and 5 and powered by the cog-wheels 6 and 7, connected with each other by means of a notched belt 8. The cog-wheel 6 is mounted on an extension of the axle of an electric motor 9, equipped with an electric brake 10.

A cable 11, used in normal operation, is wound onto the lower reel 4. The upper reel 5 carries an emergency cable 12, spaced apart from the operating cable by a tensioner 13.

The diameter of the cog-wheels 6 and 7 is proportioned so that the emergency cable 12 will follow in a synchronous manner the load lowered by the operating cable 11.

The reducing gears 2 and 3 are mounted respectively on the shafts 14 and 15 joined with the reels 4 and 5 and are supported on the frame 1 by means of the axles 16 and 17 upon which the ball joints 18 and 19 are mounted, with the outer ring of each ball joint being joined to a support plate 20 and 21, attached respectively to the reducing gears 2 and 3.

The input shaft of the reducing gear 2, coaxial with the shaft of the motor 9, is acted upon directly by the motor 9, while the input shaft of the reducing gear 3, parallel to the input shaft of the reducing gear 2, is driven at a suitable velocity by means of the cog-wheels 6 and 7, interconnected by the notched belt 8.

The output shafts of the reducing gears 2 and 3 are orthogonal to the input shafts and consist respectively of the shafts 14 and 15 of the reels 4 and 5.

Figure 2:
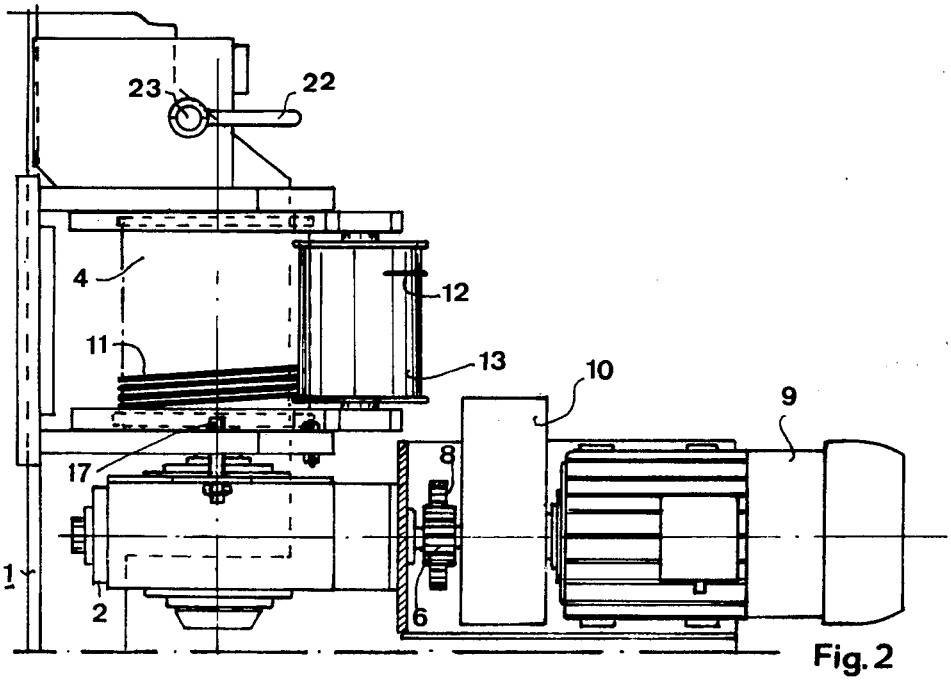
Figure 3:
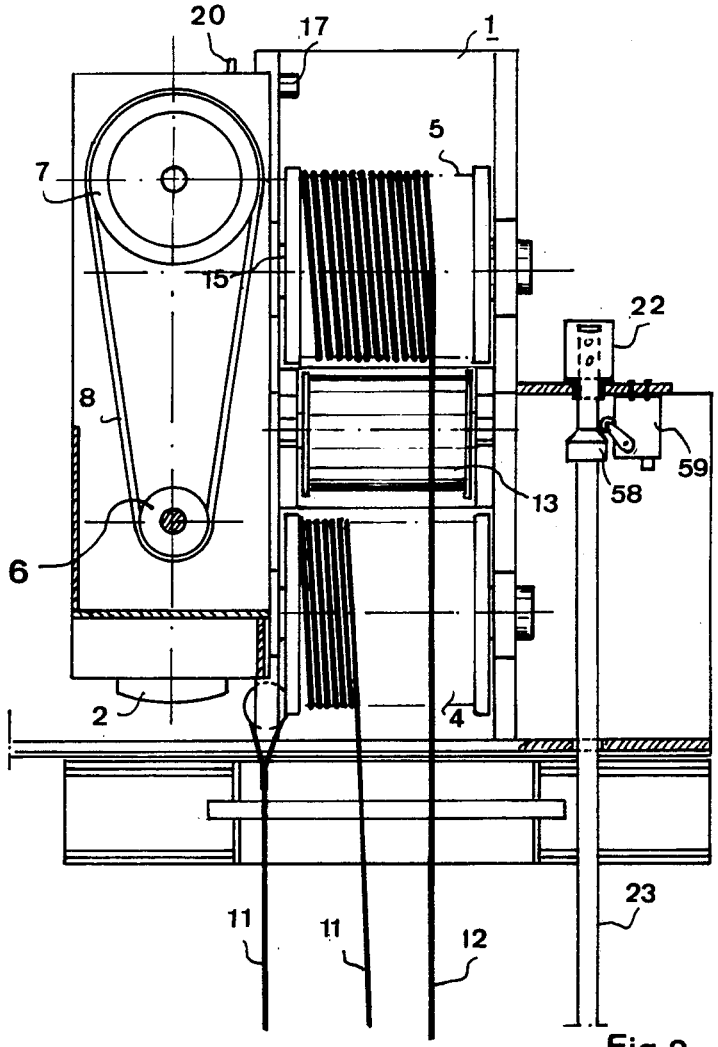

FIGS. 2 and 3 show a control handle 22 joined to a control rod 23; the role whereof shall be set forth hereinbelow.

Figure 4:
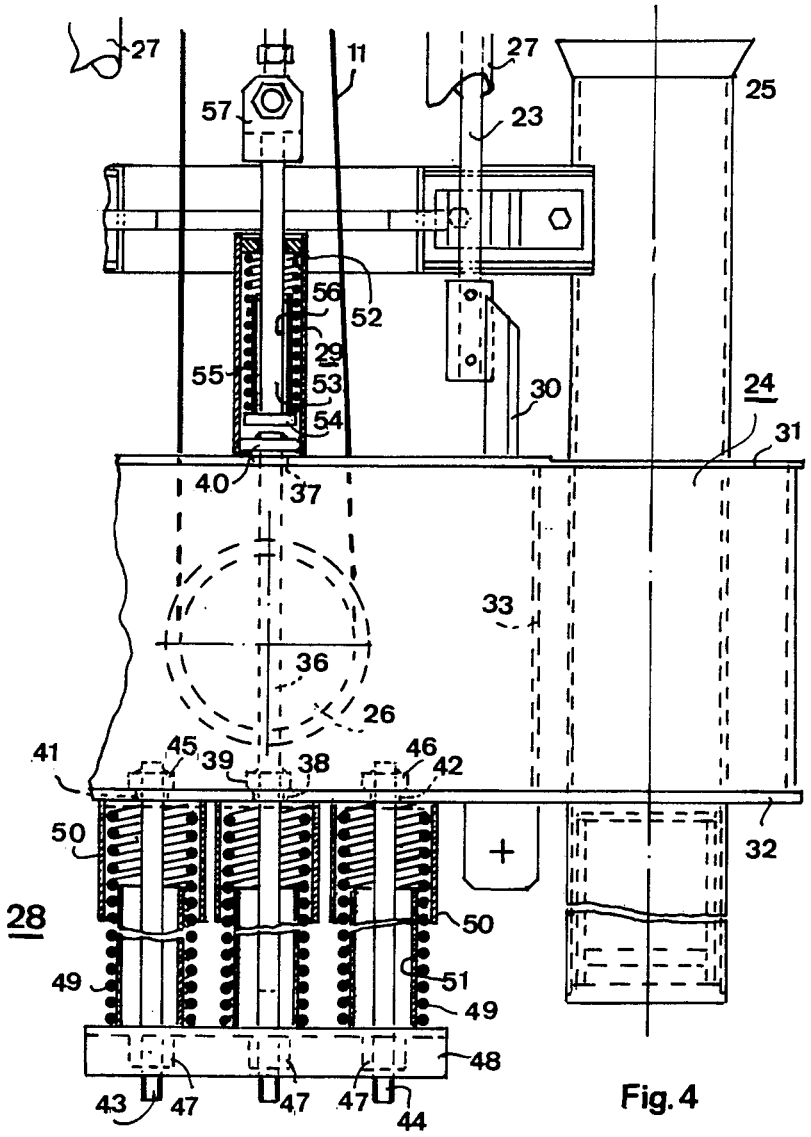
FIGS. 4, 5 and 6 show the carriage and its equipment.

FIG. 4 is a partial view of a carriage 24 designed to receive two baskets 25 placed symmetrically with respect to a center pulley 26 taking up the sides of the operating cable 11.

The carriage 24 is guided in its ascending and descending movements by two vertical guides 27, supporting guide runners, not shown, integral with the carriage 24.

The carriage 24 is equipped with an attenuating system 28 and an elastic connecting system 29 located on either side of the axis of the emergency cable 12.

FIG. 4 also shows the lower part of control rod 23, joined to a stop 30, the function of which is to limit in height the path of the carriage 24, when the control rod 23 actuated by the control handle 22, occupies a well defined angular position.

Figure 5:
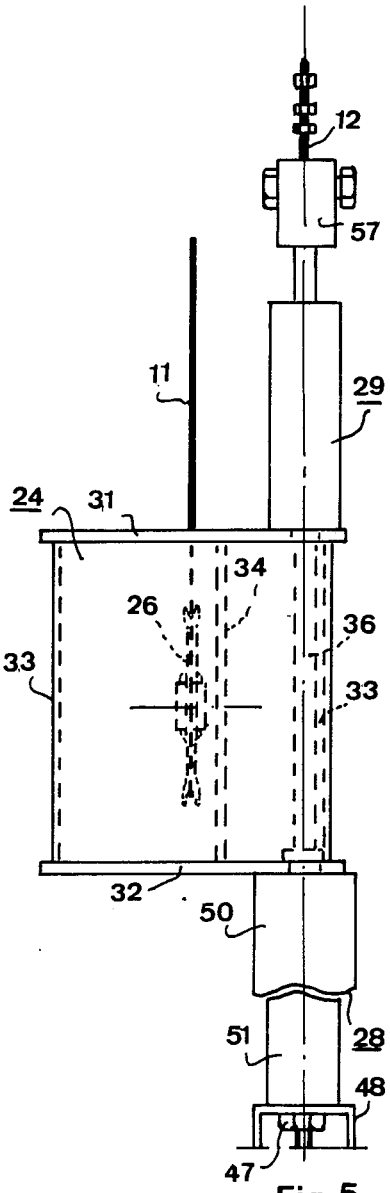

FIG. 5 illustrates the lateral divergence created by the tensioner 13 between the operating cable 11 on the one hand, the emergency cable 12, the attenuating system 28 and the elastic connecting system 29, on the other.

Figure 6:
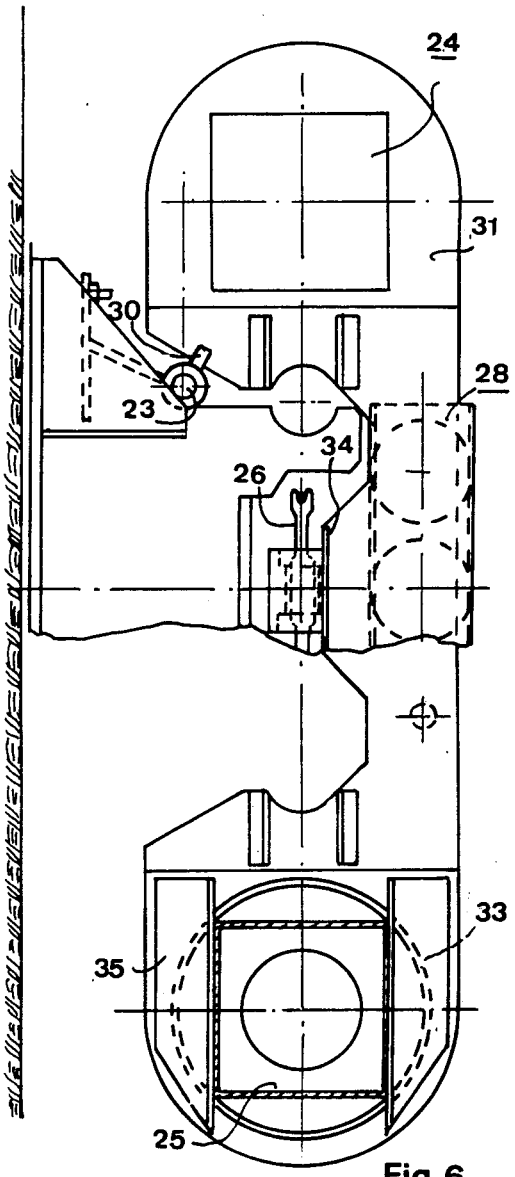

FIG. 6 shows the plan view of the carriage 24.

The carriage 24 comprises an upper plate and a lower plate 32, joined together at each end by two large diameter cylinders 33 and in the center by a center brace 34, serving to support the uplley 26. The baskets 25, each equipped with two wings 35 resting on the upper plate 31, are sliding in the cylinders 33.

The upper plate 31 and the lower plate 32 are provided with cutouts and orifices to permit the passage of the vertical guides 27, the square baskets 25 and the sides of the cable 11.

The attenuating system 28 comprises a center rod 36 capable of sliding in the holes 37 and 38, provided respectively in the upper plate 31 and the lower plate 32. However, displacement toward the bottom of the center rod 36 is limited by a stop 39, integral with the center rod 36 and resting on the lower plate 32, and by a support disk 40, also integral with the center rod 36 and resting against the upper plate 31, with or without the interposition of an intermediate piece. In the lower plate 32, holes 41 and 42 are drilled on either side of the center hole 38 to permit two other rods 43 and 44 to slide in the same manner as the center rod 36. The stops 45 and 46, joined to the upper ends respectively of the rods 43 and 44, prevent their displacement in the downward direction by abutting against the lower plate 32. The lower ends of the assembly of the three rods 36, 43 and 44 are threaded to receive the nuts 47 serving to compress by means of an end piece 48, in the shape of a U, three helical springs 49, coaxial with the three rods 36, 43 and 44 and working in compression. These springs are guided by a set of cylinders 50 and 51, distributed in pairs, each comprising a cylinder with a diameter sufficiently large for the helical springs 49 to slide inside and another cylinder with a diameter sufficiently small to thread onto it the helical springs 49, on the outside.

It is possible to regulate the prestress of the attenuating springs 49 by displacing the end piece 48 of the lower plate 32 of the carriage 24 by means of the nuts 47.

The elastic connecting system 29 is also located in the axis of the emergency cable 12. It consists of a cylinder 52 joined to the end of the center rod 36 and resting against the upper plate 31. In the cylinder 52, a suspension rod 53 is sliding, said rod being equipped at its end with a disk 54 functioning as a piston and serving to compress a helical spring 55, the compression of which is limited by an inner tube 56.

The suspension rod 53 terminates at its upper part in a coupler 57 retaining the end of the emergency cable 12.

The elastic connecting system 29 maintains the emergency cable under constant stress and makes it possible to equalize small deviations of synchronism between the unwinding velocity of the emergency cable 12 and the velocity of the displacement of the carriage 24.

In case of a rupture of the operating cable 11, the attenuated drop movement of the carriage 24 compresses the spring 55 and places the inner cylinder 56 against its stop. The load of the carriage 24 is transferred to the emergency cable 12 by a force path through the cylinder 52, the center rod 36, the end piece 48 and the attenuating springs 49, which in turn are compressed to reduce the effect of the impact on the emergency cable 12 by letting the three rods 36, 43 and 44 slide in the upward direction. The synchronization existing in operation between the velocity of the displacement of the carriage 24 and the emergency cable 12 and the constant tension of the emergency cable 12 by means of the elastic connecting system 29 contribute further to a reduction of the effect of the impact on the emergency cable 12 and on the fuel elements contained in the baskets 25.

As the carriage 24 is used to manipulate irradiated fuel, it must be immersed permanently under a layer of water, the minimum value of which is strictly regulated. To observe these regulations with certainty, the lifting device of the carriage 24 is equipped with a control handle 22 permitting the appropriate positioning of the stop 30. In this manner, even if the normal system to arrest the carriage 24 should fail, the stop 30 makes it possible for a cam 58 attached to the control rod 23 to actuate a switch 59 interrupting the supply of power to the motor 9 and activating the electric brake 10.

With this safety device, the shocks transmitted to the fuel elements in case of a rupture of the operating cable 11 are not comparable to those following a free fall of the carriage 24 to the bottom of the pool, and all risks of a contamination of said pool are eliminated.

Further examples may be effected by using technical means equivalent to the notched belt 8 and to the cogwheels 6 and 7 to obtain synchronization between the reels 4 and 5.

Similarly, the means 57 of attaching the emergency cable 12 may be replaced by a pulley operating in the same manner as the pulley 26, by increasing consequently the winding velocity of the emergency cable 12.

Figure 7:
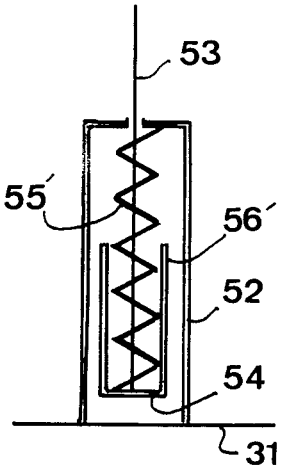
FIGS. 7, 8 and 9 illustrate schematically certain variations.

In a further example of the elastic connection shown in FIG. 7, a helical spring 55' may be used, said spring working in compression inside a cylinder 56', integral with the disk 54 to abut against the top of the cylinder 52.

Figure 8:
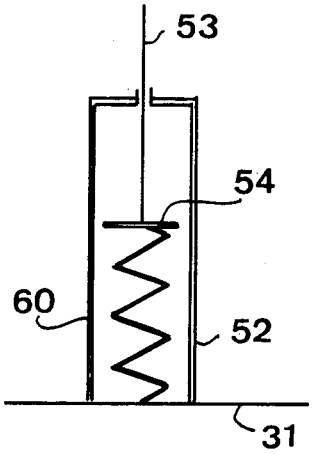
Figure 9:
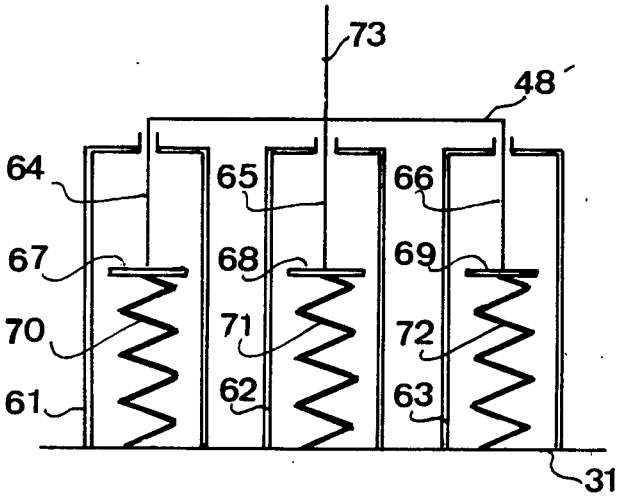

In another example of embodiment of the elastic connecting system 29 schematically shown in FIG. 8, a helical spring 60 may work in traction inside the cylinder 52, integral with the upper plate 31, when one end of said spring 60 is fastened by one end to the upper plate 31 and at the other end to the disk 54, serving as a stop at the top of the cylinder 52 to limit the extension of the spring 60.

The attenuating system 28 may also consist of springs working in traction. An example of embodiment is shown in FIG. 3.

The upper plate 31 of the carriage 24 is joined to the three cylinders 61, 62 and 63. In each of the cylinders 61, 62 and 63, a rod 64, 65 and 66 is sliding respectively, the disk 67, 68 and 69 of which serves as a stop to limit the path of the spring 70, 71, 72, the ends whereof are attached respectively to the upper plate 31 on the one hand and to the disks 67, 68 and 69 on the other. In this embodiment, the rods 64, 65 and 66 are integral with the end piece 48' itself connected with a rod 73, being attached either to the elastic connecting system 29 or directly to the coupler 57.

I claim:

1. Nuclear fuel element loading mechanism comprising an electric motor (9) activating a winding reel (4) by means of a reducing gear (2) to permit the displacement by means of an operating cable (11) in vertical guides (27) of a carriage (24) equipped with a pulley (26) and a basket (25) capable of containing a nuclear fuel element, characterized in that it comprises a safety device containing a second winding reel (4) carrying at least one emergency cable (12) attached to the carriage (24), moving at the velocity of the carriage (24) but not carrying the said carriage (24) in normal operation.

2. Loading mechanism according to claim 1, characterized in that the second winding reel (5) carrying the emergency cable (12) is moved by a second reducing gear (3), the input shaft (15) of which is carrying a cog-wheel (7) connected by a notched belt (6) located on the input shaft (14) of the first reducing gear (2).

3. Loading mechanism according to claim 1, characterized in that a tensioner (13) is spacing apart the emergency cable (12) from the operating cable (11).

4. Loading mechanism according to claim 1, characterized in that the carriage (24) is equipped with a second basket (25) and an elastic connecting system (20) joining the carriage (24) to the emergency cable (12).

5. Loading mechanism according to claim 1, characterized in that the carriage (24) is equipped with an attenuating system (28) elastically joining the emergency cable (12) to at least one of the plates (31 or 32) of the carriage 24.

6. Loading mechanism according to claim 1, characterized in that the elastic connecting system comprises a suspension rod (53) equipped on one end with a coupler (57) and on the other end with a disk (54) sliding inside a cylinder (52) to deform a helical cylinder (55 or 55') coaxial with the suspension rod (53), with the path of said helical spring being limited by a stop (56 or 56') located inside the cylinder (52).

7. Loading mechanism according to claim 1, characterized in that the attenuation system (28) comprises at least one rod (36 or 65) sliding in at least one of the constitutive plates (31, 32) of the carriage (24) or in an element (62) joined to one of the plates (31) and at least one spring (49 or 71) coaxial with said sliding rod (36 or 65) and in that one end of the spring (49 or 71) is connected with one of the two constitutive plates (31 or 32) of the carriage (24), and in that the other end of the spring (49 or 71) is connected with a piece (48 or 68) mounted at the end of the sliding rod (36 or 65).

* * * * *